US010292905B2

(12) United States Patent
Makhalfeh et al.

(10) Patent No.: US 10,292,905 B2
(45) Date of Patent: May 21, 2019

(54) ORAL MEDICATION DISPENSING DEVICE

(71) Applicants: ASRF, International Company to Support Applied Scientific Research Fund, Amman (JO); Tareq Ziad Sami Makhalfeh, Amman (JO)

(72) Inventors: Tareq Ziad Makhalfeh, Amman (JO); Nada Nabil S. Khatib, Amman (JO)

( * ) Notice: Subject to any disclaimer, the term of this patent is extended or adjusted under 35 U.S.C. 154(b) by 47 days.

(21) Appl. No.: 14/293,157

(22) Filed: Jun. 2, 2014

(65) Prior Publication Data

US 2014/0353328 A1 Dec. 4, 2014

(51) Int. Cl.
*A61J 7/04* (2006.01)
*B65D 83/04* (2006.01)

(52) U.S. Cl.
CPC ..... *A61J 7/0481* (2013.01); *A61J 7/04* (2013.01); *A61J 7/0445* (2015.05); *A61J 7/0454* (2015.05); *A61J 2205/10* (2013.01)

(58) Field of Classification Search
CPC .... A61J 1/03; A61J 7/04; A61J 7/0445; A61J 7/0454; A61J 7/0481; B65D 83/0454
See application file for complete search history.

(56) References Cited

U.S. PATENT DOCUMENTS 3,926,335 A * 12/1975 Dangles ..... A47F 1/04 206/533
4,667,959 A * 5/1987 Pfeiffer ..... A63F 1/14 221/265
4,811,764 A * 3/1989 McLaughlin ..... A61J 7/0084 141/104
5,323,929 A * 6/1994 Marlar ..... A61J 7/0409 221/121
5,392,952 A * 2/1995 Bowden ..... A61J 7/0481 221/15
6,510,962 B1 * 1/2003 Lim ..... A61J 7/0481 221/15
8,622,241 B2 * 1/2014 Geboers ..... A61J 7/0084 206/533
2003/0127463 A1 * 7/2003 Varis ..... A61J 7/0084 221/2
2004/0182873 A1 * 9/2004 Baum ..... A61J 7/0481 221/15

(Continued)

*Primary Examiner* — Gene O Crawford
*Assistant Examiner* — Kelvin L Randall, Jr.
(74) *Attorney, Agent, or Firm* — The Law Firm of Brett M. Maland; Brett M. Maland

(57) ABSTRACT

The present invention relates to an intelligent medication dispensing device that gives a patient access to his/her right daily doses of oral solid medications anywhere at the right time. The device is programmed to alert the patient when the doses due time occurs. The medication dispensing device of the present invention comprises essentially a plurality of cartridges divided into a plurality of compartments, a plurality of cylinders to position the cartridges in the device of the present invention, a medication box, a non-taken medication storage component, a portable component, and a plurality of actuators. The portable component can be taken by the patient to any place in order for such patient to adhere to his/her medication doses. The device of the present invention stores the missed dosages in the non-taken medication storage component, and thus prevents the accumulation of such missed doses with a new dose, which has its due time occurred.

14 Claims, 6 Drawing Sheets

(56) References Cited

U.S. PATENT DOCUMENTS

| | | | | |
|---|---|---|---|---|
| 2006/0184271 | A1* | 8/2006 | Loveless | A61J 7/0084 700/231 |
| 2008/0017656 | A1* | 1/2008 | Hutchinson | B65B 5/103 221/7 |
| 2011/0022224 | A1* | 1/2011 | Park | A61J 7/0409 700/232 |
| 2012/0029693 | A1* | 2/2012 | Bear | A61J 7/0481 700/244 |
| 2012/0187142 | A1* | 7/2012 | Flowers | G07F 17/0092 221/7 |
| 2014/0097195 | A1* | 4/2014 | Anthony | G06F 19/3462 221/13 |
| 2015/0342830 | A1* | 12/2015 | Bujalski | A61J 7/0445 221/1 |
| 2016/0008226 | A1* | 1/2016 | Hines | A61J 7/0481 221/12 |

* cited by examiner

ORAL MEDICATION DISPENSING DEVICE

FIELD

The field of the present invention relates to personal medication dispensing devices, especially to those that have portable components to enable the adherence to medication dosages at any place.

CROSS REFERENCE TO RELATED APPLICATION

This application claims priority to Jordanian Patent Application 2013/169 filed on Jun. 3, 2013.

BACKGROUND

Many people live with chronic diseases, and must take medications according to specific dosage schedules in order to have healthier, longer, and overall higher quality of life. The specific dosage schedules often require patients to take certain medications at specific times each day. And for many, multiple medications and complicated schedules make it a challenge to manage that the appropriate dosages.

For this reason, solutions disclosing automatic medication dispensers which give the patient access to medication dosages at the right time have been adopted in the art.

U.S. Pat. No. 6,145,697 discloses a device for enabling a patient to have ready access to a daily dosage of medication placed in compartments at predetermined time periods. The device comprises an annular plate member having a plurality of medicine receiving compartments formed adjacent the periphery thereof. Specific dosages in the form of capsules or pills are sequentially placed in selected compartments. In a preferred mode, up to four compartments are loaded in sequence to provide one dosage, up to four sequences of four compartments allowing four daily dosages to be provided. An annular top cover member is positioned over the plate member, the cover member including a window or a door. The annular compartment containing member is controlled in a manner such that a selected compartment is positioned at a location under the window. When the window is so located, an alarm is energized to alert the patient that the dosage in that compartment is available for use. When the door is opened, the alarm is deactivated. An indexing mechanism is provided to rotate the plate member so that the adjacent compartment is rotated beneath the window. As the plate member is rotated, the window is automatically shut before the alarm for the next compartment is energized. A locking member is provided so that only the health provider can have access to all the compartments and thus determine if the patient has complied with the specified dosage regimen.

U.S. Pat. No. 8,136,666 discloses an apparatus for dispensing medications comprising a holder device containing a bottom surface, a sidewall engaging the bottom surface, a pair of radial walls adjoining a center of the bottom surface and the sidewall, and a sloped slide adjoining the pair of radial walls. In a preferred embodiment, the holder device further comprises seven pairs of radial walls to correspond with each day of the week. The present invention also includes a plurality of compartments within each pair of radial walls, which correspond to the time periods during which medication must be taken during a single day. Each compartment according to this embodiment contains a sloped slide. This solution further provides a method for loading the apparatus whereby a filling tray with wells is placed on the holder device, the filling tray is arranged so that each well empties into a compartment, a number of articles are poured onto the filling tray, and spread over the tray so that the desired number of articles fall into each well.

United States patent application US20070187423 discloses a medication dispenser that provides automation to the steps of locating and acquiring unit-based doses of certain medications to be administered to a patient. The dispenser includes a frame and one or more cartridges that may be mounted onto the frame. A set of slots sized for holding unit-based doses of medication extend through a body portion of the cartridge. A movement device is also positioned relative to the frame and is configured to induce movement of selected unit-based medication doses out of associated slots in the cartridge, so that the dispensed doses may be retrieved.

Among the commercially available products in the market, there is provided a portable medication dispenser called (e-pill medimi portable pill dispenser); wherein such dispenser can supply 1 or 2 medications up to 15 times per day.

The disclosed devices and apparatuses found in the prior art have to be modified in order to give the patient access to the right dosages of oral solid medications at the right time and at any place by providing a medication dispensing device that provides multiple weeks of dosages of multiple medications that must be taken at different times of day, and wherein that device has a portable component, that can be filled and unfilled automatically and wherein access can be controlled automatically.

SUMMARY

Therefore, it is an object of the present invention to have an intelligent medication dispensing device in which medication dosages are filled and emptied automatically, wherein such device contains a portable component which gives the patient access to the right doses of medications at the right time even when the patient is mobile.

It is an aspect of the present invention to have a medication dispensing device that gives the patient access to the doses only at the due time of such doses.

It is another aspect of the present invention to have a medication dispensing device which gives the patient or the health keeper feedback about the adherence details, wherein such feedback can either be conducted by sending text messages to predefined phone number using a global system for mobile communications module (GSM) or by sending emails using wireless connection systems or wired communication systems. The feedback could be provided through other interfaces, such as an app on a care provider's electronic device.

It is another aspect of the present invention to have a medication dispensing device which has a component for storing the missed medication dosages, so that no accumulation of dosages happens when the due time of the next dose arrives. Relatedly, it is another aspect of this invention to separate those missed medication dosages.

The medication dispensing device of the present invention comprises a plurality of cartridges, wherein each of such cartridges holds one medication or multiple medications having the same due time for all regimens, wherein each cartridge is split by means of sliding separating walls into a plurality of compartments. The medications are generally in the form of solid oral medications, which include gelcaps and other forms typically swallowed. Each cartridge may further comprises a plurality of holes ordered in a unique pattern to represent a binary code for recognizing the cartridge number. In a preferred embodiment, the medication dispensing device of the present invention further comprises two cylinders to store or hold the cartridges, and a base with a medication box, wherein such box holds the total dose and has a sliding base to enable the emptying of such box if the dosage is missed.

In a preferred embodiment, the medication dispensing device of the present invention further comprises a portable component that can be taken by the patient anywhere in order to access the doses at the right time at any place.

In a preferred embodiment, the medication dispensing device contains a pills shifter, wherein such shifter rotates to transfer the dropped pills from the cartridges to the medication box or the portable component. The portable component is filled and emptied automatically when such component is inside the device.

BRIEF DESCRIPTION OF DRAWINGS

The present invention will now be described with reference to the accompanying drawings, which represent a preferred embodiment of the present invention without restricting the scope of the invention, and in which.

DETAILED DESCRIPTION OF DRAWINGS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the claims, along with the full scope of equivalents to which such claims are entitled.

In this description, references to "one embodiment", "an embodiment", "a preferred embodiment", or "embodiments" mean that the feature or features being referred to are included in at least one embodiment of the technology. Separate references to "one embodiment", "an embodiment", "a preferred embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein. Also for example, many of the walls and features in this invention are described as curved. However, the invention should be interpreted to include walls and features that other than curved and which allow for rotation.

FIGS. 1, 2, 3, 4, 5, and 6 illustrate a medication dispensing device configured according to a preferred embodiment of the present invention, wherein such embodiment comprises a cylindrical-shaped body 1 with an upper detachable surface 100, a base 101, a curved wall 102 having a circular cross-section when taken perpendicular to the central line of such wall.

Figure 4:
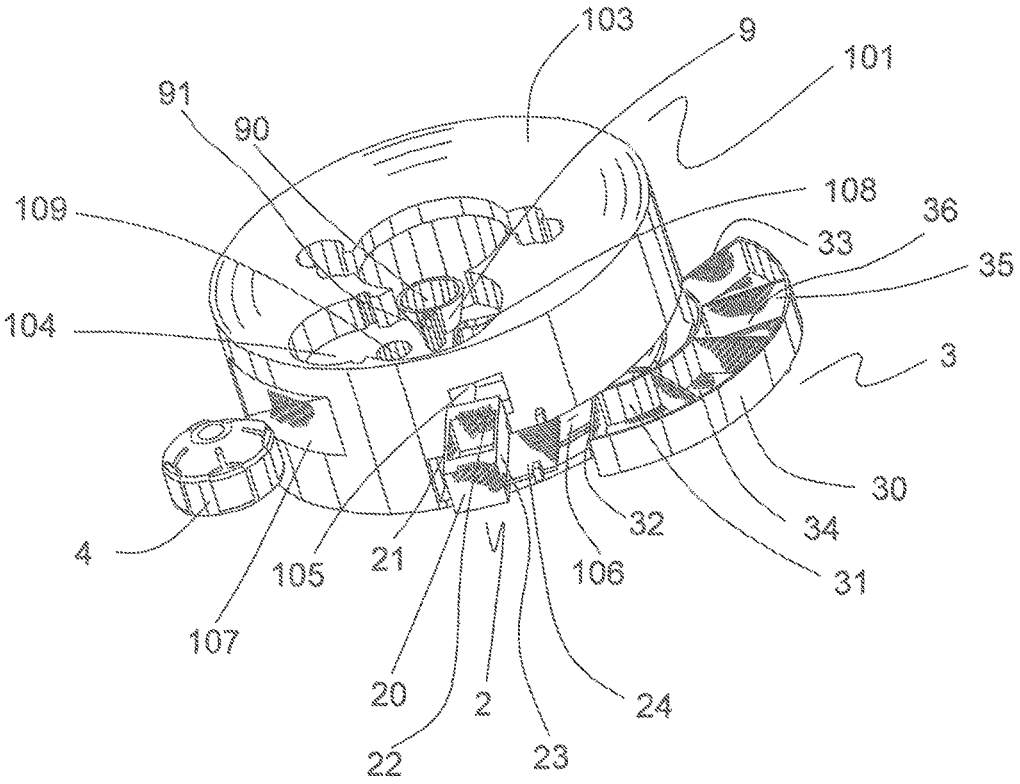
FIG. 4 is a perspective view of a medication dispensing device base configured according to a preferred embodiment of the present invention.

Referring to FIG. 4, the base 101 has an upper surface 103 and a slightly lower top surface 104, a plurality of openings 105, 106, and 107 in addition to two holes 108 and 109, wherein a medication box 2 is inserted in one of such openings 105, while a non-taken medication storage box 3 is inserted in another opening 106, and a portable component 4 is stored in opening 107. The openings 105 and 106 lay on the same longitudinal vertical line, wherein such openings are connected by a hole that penetrates the whole vertical distance between such openings 105 and 106 forming a vertical path between such openings.

Figure 1:
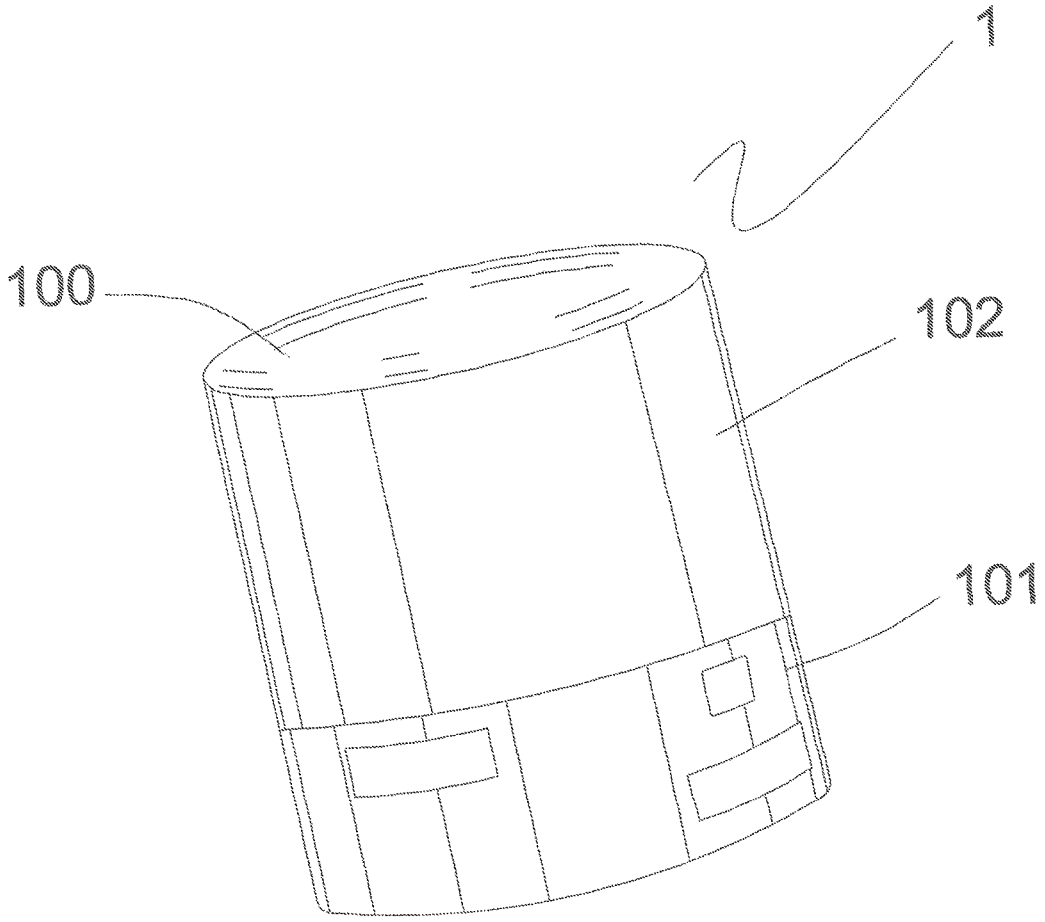
FIG. 1 is a perspective view of a medication dispensing device configured according to a preferred embodiment of the present invention.
Figure 2:
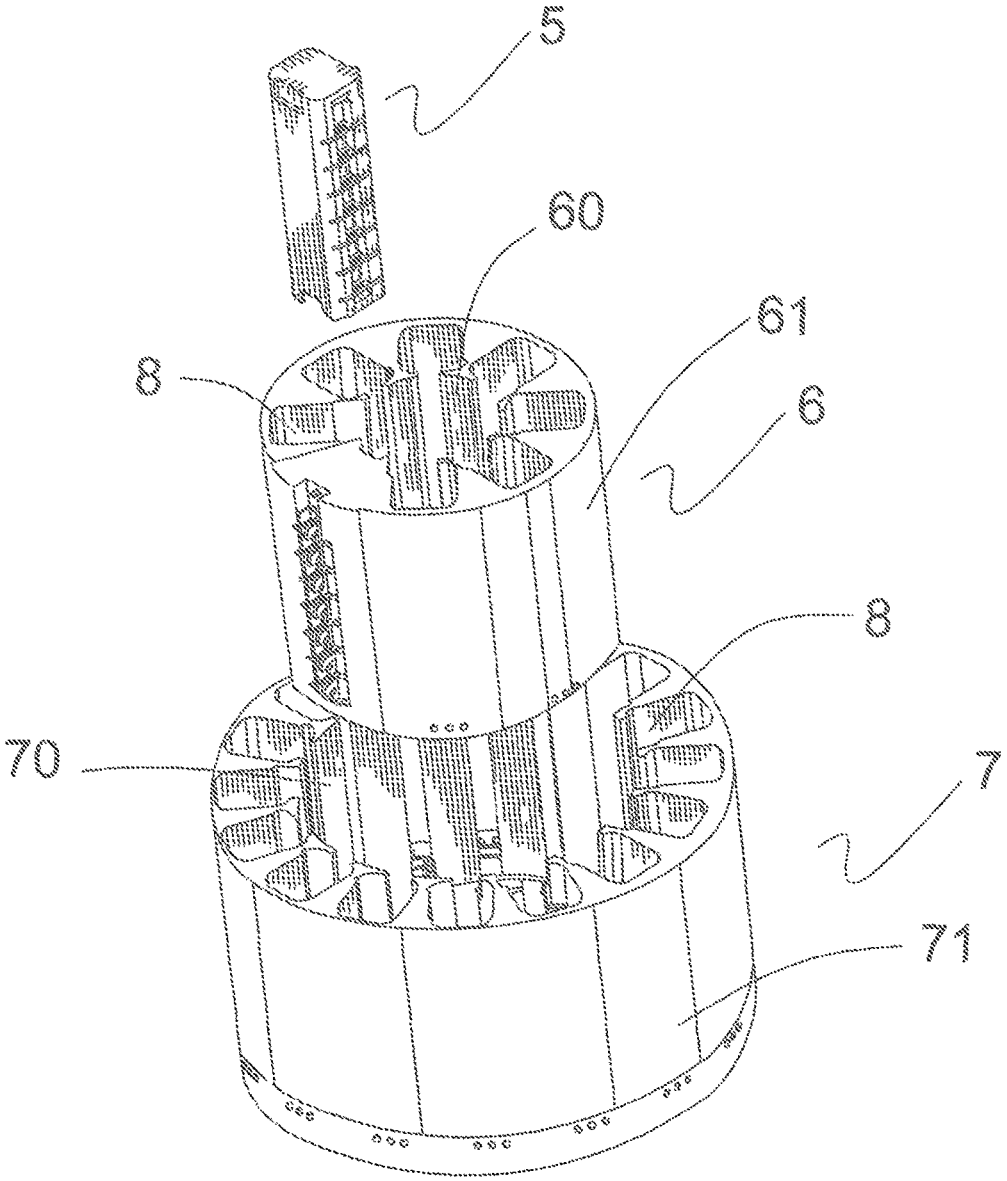
FIG. 2 is an exploded view of a cartridge, and two cylinders of a medication dispensing device configured according to a preferred embodiment of the present invention.
Figure 3:
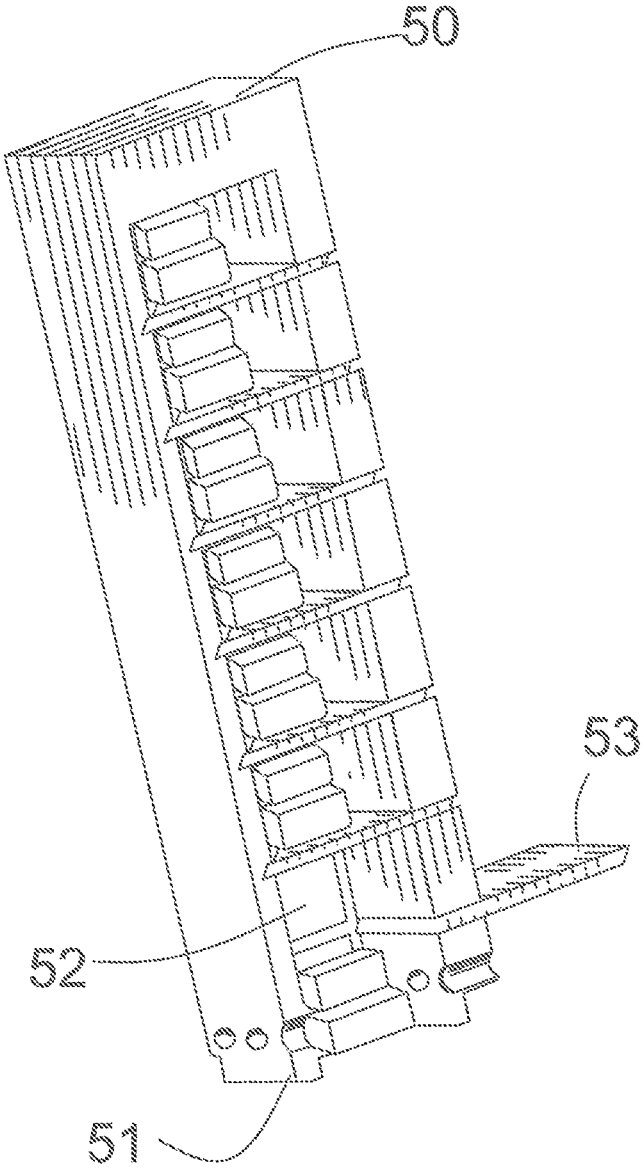
FIG. 3 is a cross-sectional view of a medication dispensing device cartridge taken parallel to the longitudinal direction of such cartridge configured according to a preferred embodiment of the present invention.

As shown in FIGS. 2 and 3, in a preferred embodiment, the medication dispensing device also comprises a plurality of cartridges 5 having an upper end 50 and a lower end 51 divided into a plurality of similar compartments 52 by means of sliding separating walls 53. The compartments 52 are collinear and are penetrated by the longitudinal axis of the cartridge. Each of the cartridges 5 has an identification means such as a unique pattern of a plurality of holes near its lower end 51 or a barcode readable by the device, wherein such identification means are used to recognize each cartridge from the other cartridges and it may hold the data about the medication type, dosage time, expiration date and patient information. In one embodiment, the unique codes on the cartridges 51 could be used to identify the position of the cartridge in the cylinder.

In a preferred embodiment, each cartridge is generally intended to represent a multiday supply of oral medications. Each compartment represents the dosage that should be taken at one time, and can contain more than one pill of an oral medication. Even though each cartridge is generally intended to represent a multiday supply of oral medications, for medication dosage schedules that do not require many medications to be taken each day. For example, if a patient's dosage schedule requires one dose each day, then this cartridge will cover the number of days equal to number of the compartments. Similarly, if a dosage schedule must be taken once per week, then the cartridge will supply a one week supply in each compartment. In a preferred embodiment, the medication dispensing system will hold forty nine or more compartments. In another preferred embodiment, the medication dispensing system will hold one hundred twelve or more compartments. In another preferred embodiment, the medication dispensing system will hold one hundred sixty one or more compartments. The cartridges may be modified to hold more or less compartments and the coaxial cylinders may be modified to hold more or less cartridges.

As shown in FIG. 2, in a preferred embodiment, the medication dispensing device of the present invention comprises a plurality of coaxial cylinders, with at least an inner cylinder 6 and an outer cylinder 7. Each of the cylinders 6 and 7 has an internal curved wall 60 and 70 respectively and an external curved wall 61 and 71 respectively. The external wall 61 of the cylinder 6 has a larger diameter than that of the internal wall 60. The diameter of the external wall 71 of the cylinder 7 is larger than the diameter of the internal wall 70. In the preferred embodiment of the present invention, the diameter of the external wall 61 is slightly smaller than the diameter of the internal wall 70 to enable the insertion of the cylinder of the smaller diameter 6 in the cylinder of the larger diameter 7. The difference in the diameters of the walls 61 and 70 enables rotation of the cylinders 6 and 7 to each other. Each of the cylinders 6 and 7 has a plurality of cartridge holders 8 distributed radially between the inner wall and the outer wall of each cylinder, wherein such cartridge holders 8 penetrate the whole length of each cylinder 6 and 7, wherein the dimensions of such cartridge holders 8 should be sufficient to enable the insertion of the cartridges 5 in such cartridge holders 8 without permitting any substantial horizontal or radial relative displacement between such cartridges 5 and such cylinders 6 and 7.

In another embodiment, there is only one rotating cylinder. Such a rotating cylinder would look similar to cylinder 7. In this embodiment, the base cylinder would have approximately the same diameter as the one rotating cylinder. In another embodiment still, there are more than two rotating cylinders for holding cartridges.

Referring to FIG. 4, a preferred embodiment of the present invention further comprises a pills shifter 9 located on the base 101 at the lower top surface 104 and positioned beneath the cylinders 6 and 7 of FIG. 2, wherein such pills shifter 9 is a conical-shaped container having a vertical hole 90 passing along the length of such container. The central line of such hole 90 is aligned with the vertical line of symmetry of the pills shifter 9. The pills shifter has an external extended cylindrical protrusion 91 positioned at the outer body of such shifter, wherein the longitudinal direction of such protrusion 91 is parallel to the longitudinal direction of the pills shifter itself 9. The protrusion 91 has a cylindrical hole passing through the central line of such protrusion, wherein a rod is inserted in such hole in the protrusion acting as a pin joint that enables the rotation of such pills shifter around such pin joint. Such rod should be fixed from one of its peripheral ends to the lower top surface 104 of the base. The hole 108 is positioned above the medication box opening 105, wherein such hole penetrates the whole vertical distance between the lower surface of the base and a top of the opening 105 providing a path between the lower top surface 104 of the base cylinder and the opening 105. The hole 109 is positioned above the portable component opening 106, wherein such hole penetrates the whole vertical distance between the lower top surface 104 of the base 101 and a top of the opening 106 providing a path between the lower top surface 104 of the base and the opening 106.

In a preferred embodiment of the present invention, the medication box 2 comprises four walls 20, 21, 22, and 23 in addition to a sliding base 24. Each of the walls 20, 21, 22, and 23 has a rectangular shape and are assembled to provide a closed contour. When the sliding base 24 is opened, the contents of such box 2 are dropped into the non-taken medication storage component 3 laying in the opening 106. The sliding base 24 opens according to a specified time of the medication dosage schedule of a particular patient. For example, if a first dosage is available at 9:00 AM in the medication box, but it is not taken when the second dosage is ready at 11:00 AM, then the sliding base 24 opens at about thirty to sixty minute after 9:00 AM and the pill or pills of the first dosage fall into the non-taken medication storage box 3.

In a preferred embodiment, the pills shifter 9 will automatically shift pills to the portable component 4 whenever the portable component is in the opening 107. When the portable component is not in the opening, the pills shifter 9 will automatically shift pills to the medication box. One means for the medication dispensing system to shift pills is accomplished by a sensor that senses the presence of the portable component 4.

In a preferred embodiment, the non-taken medication storage component 3 comprises two curved walls 30 and 31, two straight walls 32 and 33, a floor 34 and a plurality of separating walls 35. In other embodiments, all walls are straight walls. In still other embodiments, all walls are curved walls. The separating walls define a plurality of similar adjacent compartments 36. The non-taken medication storage component 3 is inserted in the opening 106 and is free to rotate inside such slot in a confined angle, wherein such rotation enables the storage of different missed dosages in different adjacent compartments 36, which prevents any accumulation of dosages in one of the compartments 36.

Figure 5:
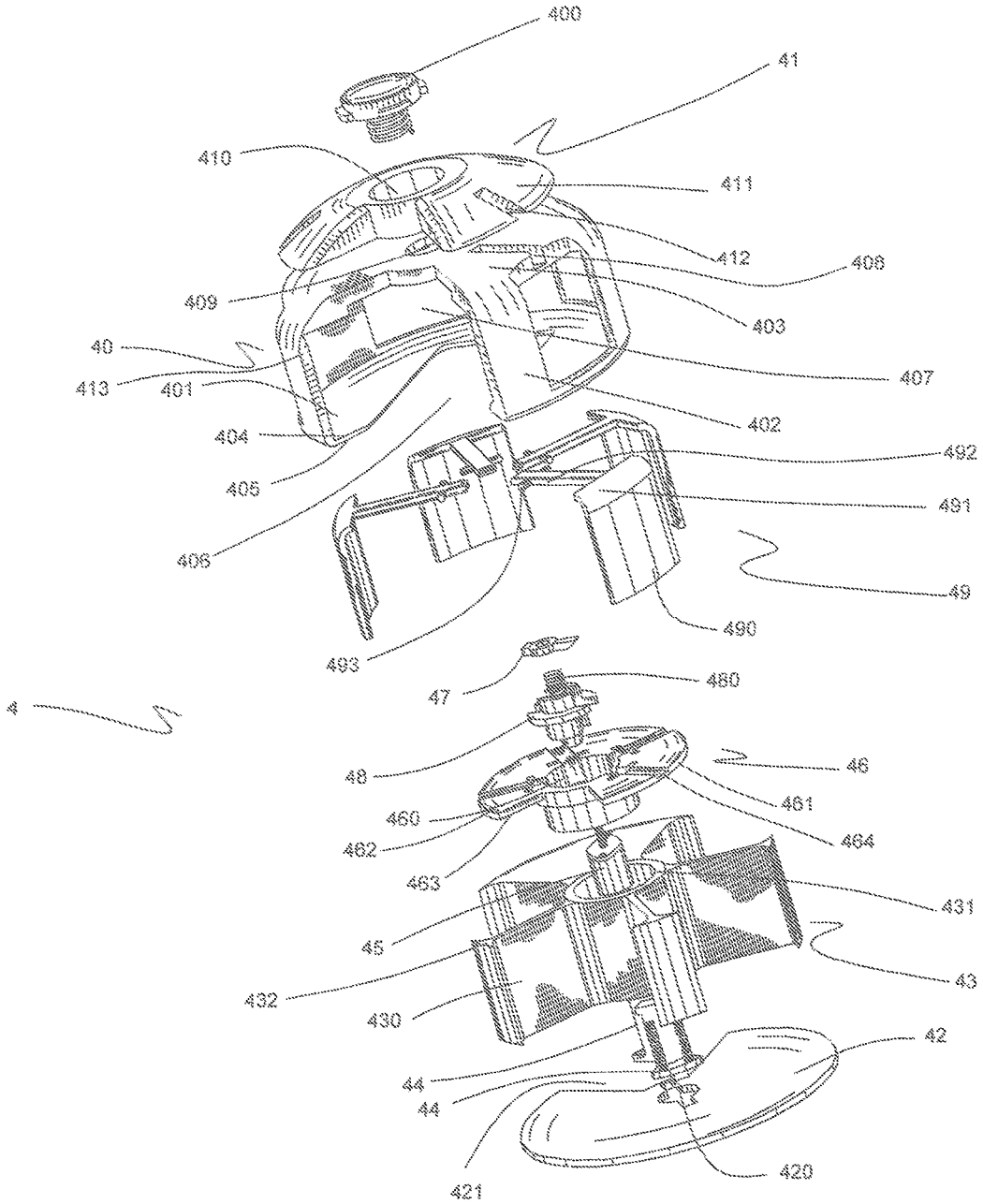
FIG. 5 is an exploded view of a portable component of a medication dispensing device configured according to a preferred embodiment of the present invention.

In a preferred embodiment of the present invention, the portable component 4 is shown in detail in FIG. 5. The portable component comprises a housing 40, an upper cover 41, a rotating base 42, a rotating partition 43, two holding pins 44, a stepper motor 45, a holding base 46, a coupling stick 47, a rotating member 48, a plurality of lateral covers 49, and a push button 400. The housing 40 has a cylindrical shape comprising a housing base 401, a curved wall 402, and a top 403. The housing base 401 has an upper surface 404 and a lower surface 405, with an opening 406 vertically penetrating the distance between the upper and the lower surface 404 and 405. The curved wall 402 has a plurality of similar lateral rectangular shaped openings 407. In the preferred embodiment of the present invention, the top 403 has a plurality of grooves 408 distributed radially on such top, wherein each of such grooves are located above one of the lateral openings 407 with each two consecutive grooves being equidistant, and the longitudinal axis of each groove is perpendicular to the vertical line of symmetry of each lateral opening 407. The top 403 has a circular hole 409 at the center of such top 403, wherein such hole penetrates the whole thickness of such top 403. In a preferred embodiment, the grooves 408 are open at the top and bottom.

The rotating base 42 is a circular plate with a circular sector shaped cut 421 in it. Such rotating base 42 has an opening 420 at its center, wherein such opening penetrates the whole thickness of such plate 42. Such opening 420 has the shape of a rectangular slot intersecting with a circular hole with the two centers of such slot and hole being collinear.

In a preferred embodiment, the rotating partition 43 comprises a plurality of similar vertical walls 430 extending radially outwardly from an enclosing wall 431. In one embodiment, the enclosing wall will be in the shape of a cylinder, but in other embodiments, the enclosing wall 431 could be angled. The enclosing wall 431 will cover the motor 45. Each of the walls 430 has a wing 432 connected to such walls 430 with the walls being perpendicular to the middle of such wings 432. The wings 432 may be curved or flanged outward. The wings 432, the walls 430, and the enclosing wall 431 create a plurality of partially enclosed chambers for holding medication (one of these chambers—the enclosed closed one—will hold the electrical and control parts.

In a preferred embodiment of the present invention, the holding pins 44 are two similar pins with springs, wherein each of such pins has an extrusion at the bottom that is inserted in the opening 420 in order to prevent the rotation of the rotating base 42 and rotating partition 43 when the portable component 4 is outside the opening 107 in FIG. 4.

In the portable component of a preferred embodiment, a stepper motor 45 rotates the rotating member 48 in order to put the coupling stick 47 in the right position, wherein the right position of such stick is either vertically above one of the lateral covers 49 when the due time of the dose occurs or between such lateral covers 49 when there is no due time of a dosage occurring at that time. The coupling stick 47 comprises a horizontal stick with a hole penetrating the whole thickness of such stick, wherein such stick is connected to the stepper motor 45 via a rotating member 48 with a spring 480. Other motorized means in addition to a stepper motor can be used in other embodiments and may directly contact a coupling mechanism to allow a chamber to open so that a patient can access their oral medications at the proper time according to that patient's medication dosage schedule.

In a preferred embodiment, the holding base 46 comprises a curved wall 460 with a lip 461 extended radially outwardly from such curved wall, wherein such lip 461 is extended partially from such wall, leaving a part of such wall without an extended lip. The lip 461 has an upper surface 462 and a lower surface 463, wherein such upper surface has a plurality of grooves 464 distributed radially on such upper surface 462. The holding base 46 keeps the rotating base 42 and the rotating partition 43 stuck together when the portable component 4 is outside the opening 107.

In a preferred embodiment, each of the lateral covers 49 of the portable component of the present device comprises a plate 490 with a slightly curved end 491, and a longitudinal stick 492 extending horizontally from the vertical line of symmetry of the portable component towards the direction of curvature of the curved end of such plate. Two similar extrusions 493 are extruded perpendicularly to the lateral sides of the longitudinal stick 492. The extended longitudinal stick 492 and the extrusions are inserted in the grooves 408.

In a preferred embodiment, the later covers are on top of the housing 40.

In a preferred embodiment, the upper cover 41 comprises a curved wall 410 with a lip extending radially outwardly 411 from the curved wall 410, wherein such lip is inclined with the maximum thickness being near the curved wall 410. The lip 411 is extending partially from the curved wall leaving a part of such wall without an extending lip. The upper cover has a plurality of openings 412, wherein such openings have the shape of the longitudinal sticks 492. The upper cover 41 is positioned above the top 403 of the housing 40 after the insertion of the longitudinal sticks 492 of the lateral covers in the grooves 408, wherein each of the openings 412 of the upper cover 41 is aligned with one of the longitudinal sticks 492.

In a preferred embodiment, the push button 400 has a spring and is inserted through the curved wall 410 of the upper cover and the circular hole 409 of the housing 40, wherein such spring helps in restoring the original position of the push button 400.

When a pre-programmed due time of a dose occurs according to a patient's medication dosage schedule, an alarm is activated for notifying the patient that the due time of the dose has occurred, and a signal is sent from a control circuit to activate the stepper motor 45 to rotate the rotating member 48, which in turn rotates the coupling stick 47 to the activated position on the longitudinal stick 492 of the lateral cover containing the right dose to be taken. When, the patient presses the push button 400 by pushing downwards on the button, the button in turn one end of the coupling stick 47 down and the other end up, thus forcing the correct lateral cover 49 to open and giving the patient access to the dose that is pre-stored in the portable component 4 chamber. But, when there is no pre-programmed due time of a dose happened the stepper motor 45 rotates the coupling stick 47 to a position between any two consecutive longitudinal sticks 492 so when the patient presses the push button 400, no exerted force is applied on the coupling stick 47, thus keeping all the lateral covers 49 closed.

In a preferred embodiment, the top 100 of the cylindrical-shaped body 1 is removed when filling such device with medications, wherein each medication can be filled in at least one of the cartridges 5, with the required number of pills of such medication for each dose stored in one of the compartments 52. The emptying of such compartments 52 starts from the closest compartment to the lower end 51 of such cartridge 5, wherein such emptying is achieved by sliding the sliding separating wall 53 using a suitable sliding actuation means. When the closest compartment to the lower end 51 is emptied, the emptying of the adjacent compartment has to be done when the due time of the next dose occurs. In such case, the sliding walls of such compartment and the sliding walls of the emptied compartments should be opened sequentially to allow the dropping of the pills from such compartments to enter the pills shifter hole 90 to be transferred then to either the medication box 2 or the portable component 4.

In the preferred embodiment of the present invention, each of the cylinders 6 and 7 rotates relative to the base 101, wherein such rotation occurs by means of a stepper motor coupled to each of the cylinders. In a preferred embodiment, the stepper motor will be positioned in the base 101, although the motor could be position above the coaxial cylinders 6 and 7 or inside the coaxial cylinders 6 and 7. In other embodiments, other suitable motors may be used. In still other embodiments, the force causing the rotation could be applied by a human. The purpose of such rotation is to position each of the cartridges 5 containing the medications required for each dose over the pills shifter 9, wherein the positioning of such cartridges 5 above such pills shifter 9 takes place in series i.e. only one cartridge is positioned above such shifter 9 at any time.

In a preferred embodiment, the coaxial cylinders will hold more than 4 different medication types of the big pill size for four weeks. In other embodiment, the coaxial cylinders will hold more as the device becomes larger.

Referring to FIG. 4, after the required dose taken from one compartment is accumulated in the pills shifter hole 90, such shifter rotates around the pin joint towards the hole 108 to be dropped in such hole 108 and stored in the medication box 2. When the due time of the dose occurs, an alarm is triggered by a control circuit to notify the patient about the dose time. If the due time of the dose is missed, the sliding base 24 is opened, and thus dropping the missed dosage in one compartment 36 of the non-taken medication storage component 3. The component 3 rotates relative to the base 101 in a confined angle such that an empty compartment is positioned beneath the medication storage box 2, wherein such rotation prevents the accumulation solid oral mediation in one compartment of the compartments 36.

Filling of the portable component 4 is achieved when such component 4 is inside the opening 107. The filling process starts by inserting a pin inside the hole 420 to move the holding pins 44 vertically up in order to release the rotating base 42 and the rotating partition 43. Then, the rotating base 42 and the rotating partition 43 will be coupled with the pin, and rotate according to its rotation. A space between two adjacent vertical walls 430 of the rotating partition 43 will be inside the hole 413 to be filled with the required dosage that dropped from the pills shifter 9 until all spaces between each two adjacent vertical walls 430 of the rotation partition 43 contain a correct dosage.

In a preferred embodiment, the emptying of the portable component 4 is achieved when the portable component 4 is inside the opening 107. The emptying process starts by lifting such component 4 by a suitable lifting means up until the component 4 becomes over the non-taken medication storage component 3 in order for the non-taken medication storage component 3 to move under the portable component 4 freely to be filled with missed dosages. Then, a rotating pin and a holding member are inserted under the holding pins 44 in the hole 420 to move the holding pins 44 vertically up to release the rotating partitions 43 fix the rotating base 42, wherein such rotating partition 43 will be coupled with the rotating pin and will rotate with such rotating pin while the rotating base 42 will be stuck with the holding members in it is place. So the required partition to be emptied will be over the cut 421 of the rotating base 42 and over one of sections 36 so the pills inside the partition will be dropped into the sections 36.

Figure 6:
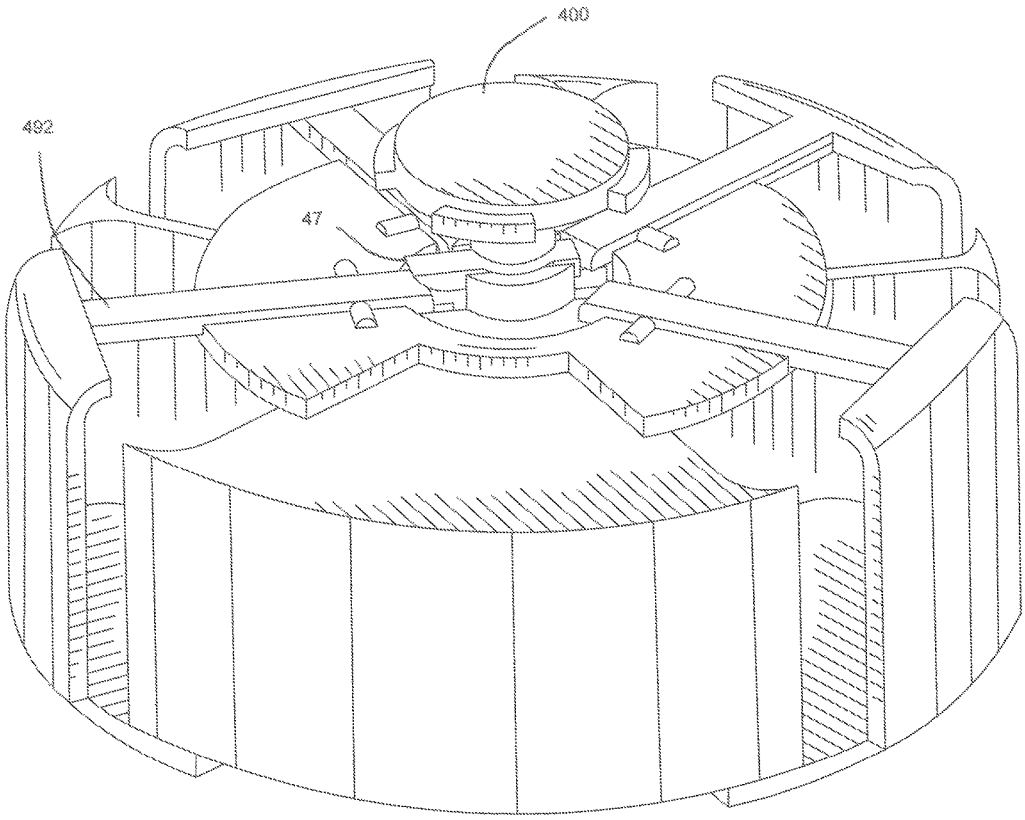
FIG. 6 is a perspective view of a portable component of a medication dispensing device configured according to a preferred embodiment of the present invention.

FIG. 6 shows a preferred embodiment of the portable component 4 without the housing 40 shown in FIG. 5. When the button 400 is pushed and when the coupling stick 47 has been activated to engage the longitudinal stick 492, the plate 490 will lift allowing the patient to access the oral medication in the chamber. The coupling stick 47 is only activated during the time frame for a specific dosage as dictated by a patient's medication dosage schedule.

The due time and the number of doses to be taken by the patient as well as the right medications for each dose are programmed either by the nurse or the person filling the device of the present invention, or can be programmed by the pharmacy or the care giver center as well via LAN.

In a preferred embodiment, a caregiver may program the device manually using an attachable keypad or remote mobile device, such as a smartphone or tablet. In this embodiment, the device will have a microcontroller to be processed and saved in memory.

In the preferred embodiment of the present invention, a timer can be used as means to determine when the due time of a dose occur.

The medication dispensing device of the present invention gives a feedback to the nurse about the adherence to doses, wherein such feedback is achieved either by sending text messages to a predefined phone number saved in the device memory via a GSM, or by producing a periodic report containing the adherence details and sending such report via LAN to the required person.

Data for the feedback may come from a variety of sources including sensors in the openings or on the portable component or on the medication box or on the non-taken medication storage box. This data may be used in combination with, or either set could be used on its own, data about the cartridges. The data about the cartridges may come bar codes or other identifies on the cartridges. Additional data could be sent to the medication dispensing device over means described above.

In the preferred embodiment of the present invention, the controller that controls all the mechanisms that take place in the device comprises a microcontroller.

While the invention has been described in details and with reference to specific embodiments thereof, it will be apparent to one skilled in the art that various additions, omissions, and modifications can be made without departing from the spirit and scope thereof.

Although the above description contains many specificities, these should not be construed as limitations on the scope of the invention but is merely representative of the presently preferred embodiment of the invention. The embodiment of the invention described above is intended to be exemplary only. The scope of the invention is therefore intended to be limited solely by the scope of the appended claims.

We claim:

1. A medication dispensing device comprising a plurality of coaxial cylinders configured to contain a supply of doses of oral medication, a base having a plurality of openings positioned below the plurality of coaxial cylinders, a first opening configured to receive a missed medication component, the missed medication component configured to hold missed dosages of the oral medication and to provide feedback data on medication adherence and a portable component capable of being removed from a second opening, the portable component having a plurality of chambers for containing multiple doses of the oral medications, wherein the plurality of chambers in the portable component are configured to be filled automatically by the supply of doses of oral medication from the plurality of coaxial cylinders when the portable component is positioned inside the second opening, the portable component being further configured to operate independently of the medication dispensing device to deliver doses of oral medication at pre-programmed due times, and wherein the doses of the oral medication contained inside the portable component cannot be accessed by a patient unless the patient accesses the doses of oral medication at the pre-programmed due times.

2. The medication dispensing device of claim 1 wherein the plurality of coaxial cylinders are configured with a plurality of cartridge holders that are capable of receiving a plurality of same sized cartridges.

3. The medication dispensing device of claim 2, wherein the plurality of same sized cartridges are capable of storing and releasing the supply of oral medication, and wherein the supply of oral medication is comprised of separated pills.

4. The medication dispensing device of claim 1, wherein the plurality of openings remain fixed relative to the plurality of coaxial cylinders, the plurality of coaxial cylinders configured to rotate relative to a base comprising the plurality of openings and a pill shifter so that each of the doses of oral medication in the supply of doses of oral medication can feed the pill shifter, and wherein the doses of oral medication are comprised of separated pills stored in cartridges.

5. The medication dispensing device of claim 4, wherein the pill shifter operates to direct the oral medication to one of the plurality of openings, wherein the pill shifter is a conical-shaped container configured to shift a dose of oral medication to a first vertical opening that will deliver the dose of oral medication to the portable component or a second vertical opening that will deliver the dose of oral medication to a medication box having a floor, the floor having an open position and a close position, wherein the dose of oral medication delivered to the medication box will be further delivered to the missed medication component when the floor is in the open position, and wherein the dose of oral medication delivered to the medication box will stay in the medication box when the floor is in the closed position.

6. The medication dispensing device of claim 1, wherein the portable component contains a plurality of chambers, wherein each chamber is enclosed at one side by a moveable plate, and wherein the chambers are fixed when the portable component is outside the second opening, and wherein each chamber is filled with one dose of oral medication.

7. A medication dispensing device comprising one or more rotating cylinders positioned above a base with a pill shifter, the rotating cylinders containing a supply of oral medication, a portable component that is removable from the medication dispensing device and capable of operating to deliver oral medication at predetermined due times after being removed from the medication dispensing device, the portable component having a plurality of compartments capable of being automatically loaded with a plurality of doses of the oral medication from the supply of oral medication delivered from the one or more rotating cylinders, a missed medication component having a plurality of adjacent compartments, the adjacent compartments capable of containing a plurality of missed dosages of the oral medication, a medication box with a floor configured to be in an open position and a closed position, wherein the open position of the floor causes the medication box to direct the oral medications to the missed medication component, and a control mechanism that controls rotation of the rotating cylinders, wherein the pill shifter is configured to shift between a first position and a second position, the first position directing the doses of the oral medication into the portable component, the second position directing the doses of oral medication into the medication box.

8. The medication dispensing device of claim 7, wherein the one or more rotating cylinders have a plurality of cartridge holders to store a plurality of cartridges which in turn store a plurality of the oral medications that can be delivered to the pill shifter.

9. The medication dispensing device of claim 8 wherein the rotating cylinders store at least one hundred dosages.

10. The medication dispensing device of claim 7, wherein the base has a plurality of openings and wherein one of the plurality of openings is capable of holding the portable component.

11. The medication dispensing device of claim 10, wherein the one of the plurality of openings capable of holding the portable component contains a sensor mechanism for sensing when the portable component is located in the one of the plurality of openings capable of holding the portable component.

12. The medication dispensing device of claim 8, wherein the plurality of cartridges are further comprised of a plurality of compartments divided by sliding separating walls.

13. The medication dispensing device of claim 12, wherein the control mechanism is capable of being programmed to rotate the one or more rotating cylinders to deliver one of the plurality of cartridges to a position above the pill shifter and sliding the separating walls at times of day that correspond to times that a patient needs doses of oral medication.

14. The medication dispensing device of claim 8 wherein the base has a plurality of openings that receive the oral medications from the pill shifter.

* * * * *